US009494002B2

(12) United States Patent
Travis et al.

(10) Patent No.: US 9,494,002 B2
(45) Date of Patent: Nov. 15, 2016

(54) LATCHING ASSEMBLY

(71) Applicant: Strata Energy Services Inc., Blackfalds (CA)

(72) Inventors: Kenneth Adam John Travis, Blackfalds (CA); Lyle Edward Charles Filliol, Blackfalds (CA); Stewart George Wilson, Blackfalds (CA)

(73) Assignee: Reform Energy Services Corp., Calgary (CA)

( * ) Notice: Subject to any disclaimer, the term of this patent is extended or adjusted under 35 U.S.C. 154(b) by 0 days.

(21) Appl. No.: 14/426,687

(22) PCT Filed: Sep. 6, 2013

(86) PCT No.: PCT/CA2013/050692
§ 371 (c)(1),
(2) Date: Mar. 6, 2015

(87) PCT Pub. No.: WO2014/036658
PCT Pub. Date: Mar. 13, 2014

(65) Prior Publication Data

US 2015/0226024 A1 Aug. 13, 2015

Related U.S. Application Data

(60) Provisional application No. 61/697,691, filed on Sep. 6, 2012.

(51) Int. Cl.
*E21B 23/01* (2006.01)
*E21B 33/043* (2006.01)
*E21B 33/08* (2006.01)

(52) U.S. Cl.
CPC ..... *E21B 23/01* (2013.01); *E21B 33/043* (2013.01); *E21B 33/085* (2013.01)

(58) Field of Classification Search
CPC ..... E21B 23/01; E21B 33/043; E21B 33/085
See application file for complete search history.

(56) References Cited

U.S. PATENT DOCUMENTS 3,096,999 A 7/1963 Ahlstone et al.
3,661,205 A * 5/1972 Belorgey ..... E21B 23/00 166/104

(Continued)

FOREIGN PATENT DOCUMENTS

CA 1 108 984 A1 9/1981
CA 2 805 630 A1 1/2012

(Continued)

OTHER PUBLICATIONS

International Search Report and Written Opinion mailed Jan. 10, 2014, issued in corresponding International Application No. PCT/CA2013/050692, filed Sep. 6, 2013, 7 pages.

(Continued)

*Primary Examiner* — James G Sayre
(74) *Attorney, Agent, or Firm* — Christensen O'Connor Johnson Kindness PLLC

(57) ABSTRACT

A latching assembly has a tubular housing having an inner surface that defines an inner bore and an outer surface. A latch moves between a latch position that extends out from the outer surface and an unlatched position that is retracted from the latch position. A latching actuator moves between a first axial position that moves the latch to the latch position and a second axial position that moves the latch to the unlatched position. A manual release moves axially in response to a mechanical force to selectively move the latching actuator to the second axial position.

21 Claims, 12 Drawing Sheets

(56) References Cited

U.S. PATENT DOCUMENTS

| | | | | |
|---|---|---|---|---|
| 4,374,630 | A | 2/1983 | Fraser, Jr. | |
| 5,213,158 | A | 5/1993 | Bailey et al. | |
| 5,340,182 | A | 8/1994 | Busink et al. | |
| 5,353,877 | A | 10/1994 | DeCorps | |
| 5,437,489 | A | 8/1995 | Sanders et al. | |
| 5,662,181 | A | 9/1997 | Williams et al. | |
| 5,947,198 | A * | 9/1999 | McKee | E21B 17/023 166/377 |
| 6,230,824 | B1 * | 5/2001 | Peterman | E21B 21/001 166/359 |
| 6,894,500 | B2 | 5/2005 | Benimeli | |
| 6,971,413 | B2 | 12/2005 | Taylor et al. | |
| 7,237,623 | B2 | 7/2007 | Hannegan | |
| 7,258,171 | B2 | 8/2007 | Bourgoyne et al. | |
| 7,448,454 | B2 | 11/2008 | Bourgoyne et al. | |
| 7,487,837 | B2 | 2/2009 | Bailey et al. | |
| 7,699,109 | B2 | 4/2010 | May et al. | |
| 7,758,087 | B2 | 7/2010 | Niven et al. | |
| 7,798,210 | B1 | 9/2010 | Pruitt et al. | |
| 7,836,946 | B2 | 11/2010 | Bailey et al. | |
| 7,866,721 | B2 | 1/2011 | Hollin | |
| 7,926,593 | B2 | 4/2011 | Bailey et al. | |
| 7,934,545 | B2 | 5/2011 | Bailey et al. | |
| 7,997,345 | B2 | 8/2011 | Hannegan | |
| 8,016,033 | B2 | 9/2011 | Iblings et al. | |
| 8,286,734 | B2 | 10/2012 | Hannegan | |
| 2003/0000693 | A1 * | 1/2003 | Couren | E21B 33/061 166/66 |
| 2007/0051512 | A1 * | 3/2007 | Markel | E21B 47/0905 166/255.1 |
| 2007/0095540 | A1 | 5/2007 | Kozicz et al. | |
| 2008/0105462 | A1 | 5/2008 | May et al. | |
| 2008/0210471 | A1 | 9/2008 | Bailey et al. | |
| 2009/0101351 | A1 | 4/2009 | Hannegan | |
| 2009/0101411 | A1 | 4/2009 | Hannegan et al. | |
| 2009/0139724 | A1 * | 6/2009 | Gray | E21B 23/04 166/345 |
| 2009/0260829 | A1 | 10/2009 | Mathis | |
| 2010/0012317 | A1 | 1/2010 | Shelton | |
| 2011/0024189 | A1 | 2/2011 | Saeed et al. | |
| 2011/0024195 | A1 | 2/2011 | Hoyer et al. | |
| 2011/0036638 | A1 | 2/2011 | Sokol et al. | |
| 2011/0168392 | A1 | 7/2011 | Bailey et al. | |
| 2011/0168405 | A1 | 7/2011 | Parlee | |
| 2011/0214871 | A1 | 9/2011 | Leduc et al. | |
| 2011/0259612 | A1 | 10/2011 | Lovorn et al. | |
| 2012/0055677 | A1 | 3/2012 | Boyd | |
| 2012/0125633 | A1 | 5/2012 | Linde et al. | |
| 2012/0125636 | A1 | 5/2012 | Linde et al. | |
| 2014/0069720 | A1 * | 3/2014 | Gray | E21B 33/085 175/5 |

FOREIGN PATENT DOCUMENTS

| | | |
|---|---|---|
| CN | 201972685 U | 9/2011 |
| GB | 2 450 854 A | 1/2009 |

OTHER PUBLICATIONS

"PRCD 508 HC," ©2012 Pruit Tool Inc., Fort Smith, Ark., 1 page.
"Weatherford Receives World's First API 16 RCD Certification," Press Release, Weatherford, Houston, Texas, May 25, 2010, 1 page.

* cited by examiner

LATCHING ASSEMBLY

FIELD

This relates to a latching assembly, such as a latching assembly that may be used to latch a rotating control device with a riser.

BACKGROUND

Rotating control devices are often used in order to manage pressure when drilling offshore. The rotating control device is generally secured to a riser by way of a removable latch in order to simplify installation and removal. U.S. Pat. No. 7,487,837 (Bailey et al.) entitled "Riser Rotating Control Device" describes a latching assembly that connects to a riser, and that can be released remotely.

SUMMARY

There is provided a latching assembly, comprising a tubular housing having an outer surface and an inner surface that defines an inner bore and a latch carried by the housing. The latch has a latch position that extends out from the outer surface and a release position that is retracted from the latch position. An actuator moves the latch between the latch position and the release position. A first locking element moves between a locked position to secure the latch in the latch position and a release position to release the latch from the latch position.

According to an aspect, the actuator may be an electrical actuator.

According to an aspect, the latching assembly may further comprise a second locking mechanism that moves between a locked position to secure the latch in the release position, and a release position to release the latch from the release position.

According to an aspect, the electrical actuator may comprise an electromagnetic.

According to an aspect, the latch may comprise a spring element that biases the latch toward the release position.

According to an aspect, the latching assembly may further comprise a power source.

According to an aspect, the latching assembly may further comprise a power source carried by the housing.

According to an aspect, the latching assembly may further comprise a wireless controller carried by the housing, the wireless controller being programmed to control the position of the latch, the first locking element and the second locking element.

According to an aspect, the first and second locking elements may be controlled by electromagnets.

According to an aspect, the first and second locking elements may further comprise spring elements that bias the locking elements toward the locked position.

According to an aspect, the latching assembly may further comprise a tubular gripping assembly comprising a cantilevered gripping member positioned within the inner bore of the housing. The gripping member may be connected to the housing by a movable connection. The gripping member may be engaged by the latch such that movement of the latch to the release position causes the gripping member to pivot about the movable connection and extend into the inner bore to engage a tubular member.

According to an aspect, the latching assembly may comprise a secondary release element that is carried by the latch and a collar that is slidably engaged within the inner bore of the housing, the collar engaging the secondary release element as it is raised and applying a force to move the latch to the release position. The secondary release element and the collar may each comprise complementary sloped surfaces.

According to a further aspect, there may be provided, in combination, a riser defining a central bore, a drill string extending through the riser, and a latching assembly as described above positioned within the central bore of the riser and receiving the drill string within the central bore of the housing of the latching assembly. A sealing and bearing assembly may be mounted to the drill string and attached to the latching assembly.

According to a further aspect, there may be provided a latching assembly, comprising a tubular housing having an inner surface that defines an inner bore and an outer surface and a latch that moves between a latch position that extends out from the outer surface and an unlatched position that is refracted from the latch position. A latching actuator moves between a first axial position that moves the latch to the latch position and a second axial position that moves the latch to the unlatched position. A manual release moves axially in response to a mechanical force to selectively move the latching actuator to the second axial position.

According to an aspect, the latching actuator may comprise a first portion and a second portion, the latch being spaced axially between the first and second portions, wherein, in the first axial position the first portion moves the latch to the latch position and in the second axial position the second portion moves the latch to the unlatched position.

According to an aspect, the latching actuator may engage the latch by sloped surfaces to move the latching actuator between the latch position and the unlatched position.

According to an aspect, the latching actuator may lock the latch in each of the latch position and the unlatched position.

According to an aspect, the latching actuator may be hydraulically driven.

According to an aspect, the manual release may comprise a lifting ring having an engagement for engaging with a lifting tool that applies the mechanical force to the manual release.

According to an aspect, the manual release may be connected to the latching actuator by a mechanical linkage, the mechanical linkage transferring the mechanical force to the latching actuator.

Other aspects will become apparent from the description and drawings.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 7:
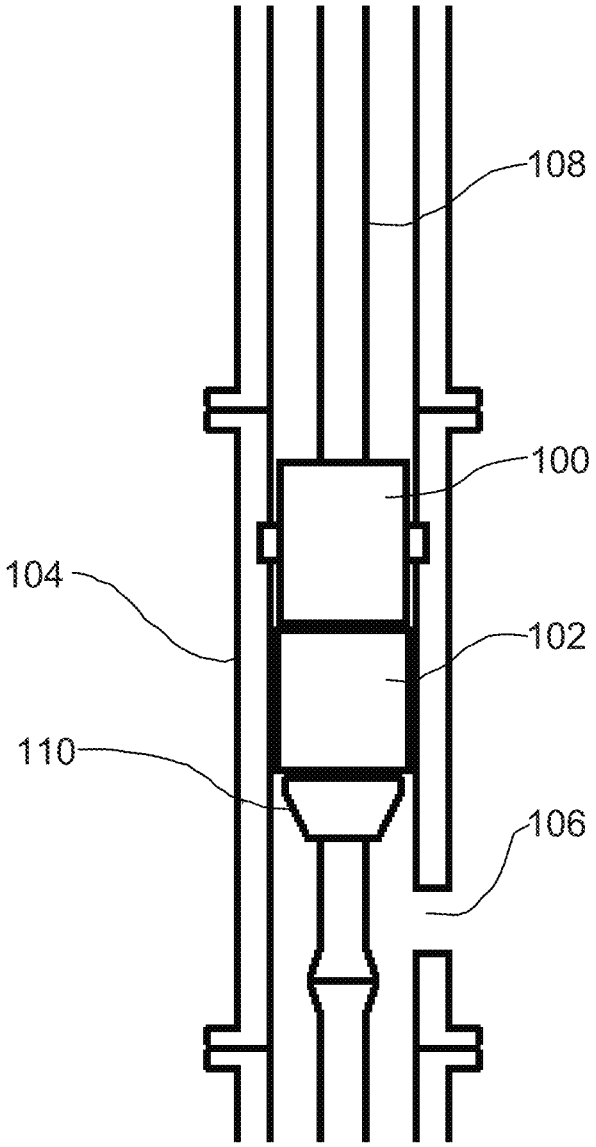
FIG. 7 is a side elevation view of a latching assembly securing a bearing assembly in a riser.
Figure 8:
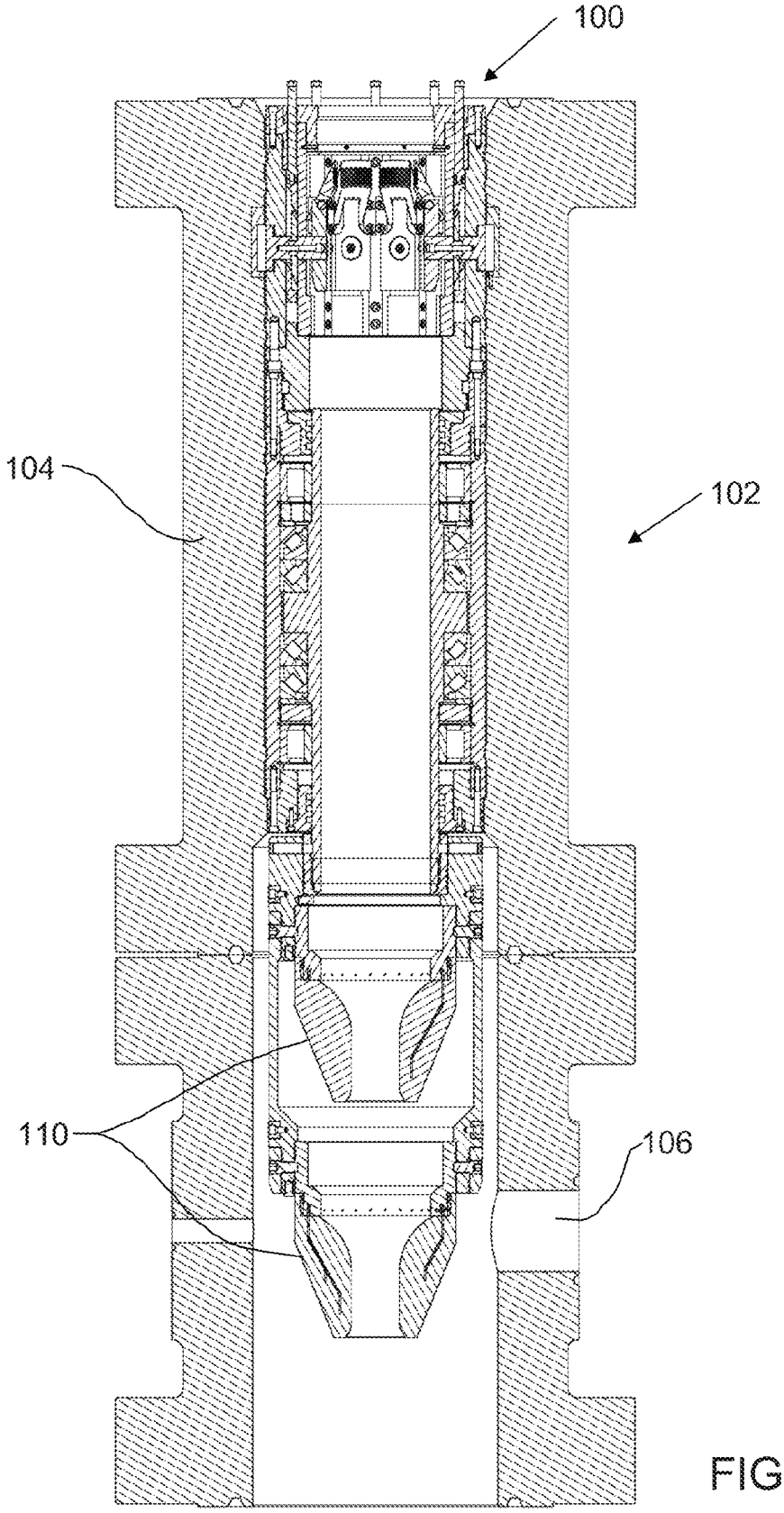
FIG. 8 is a side elevation view in section of a latching assembly securing a bearing assembly in a riser.
Figure 9:
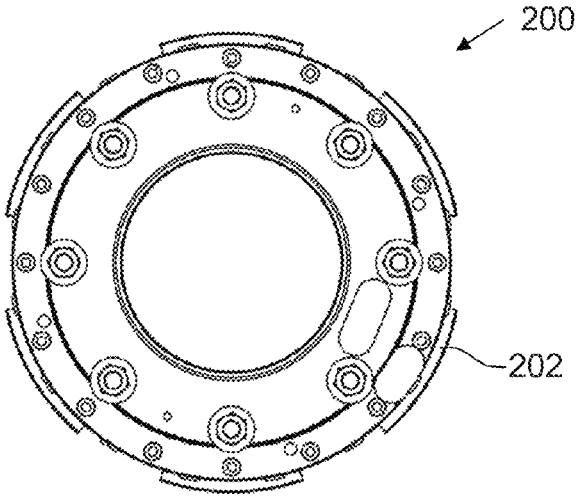
FIG. 9 is a top plan view of an alternative latching assembly in a latched position.
Figure 10:
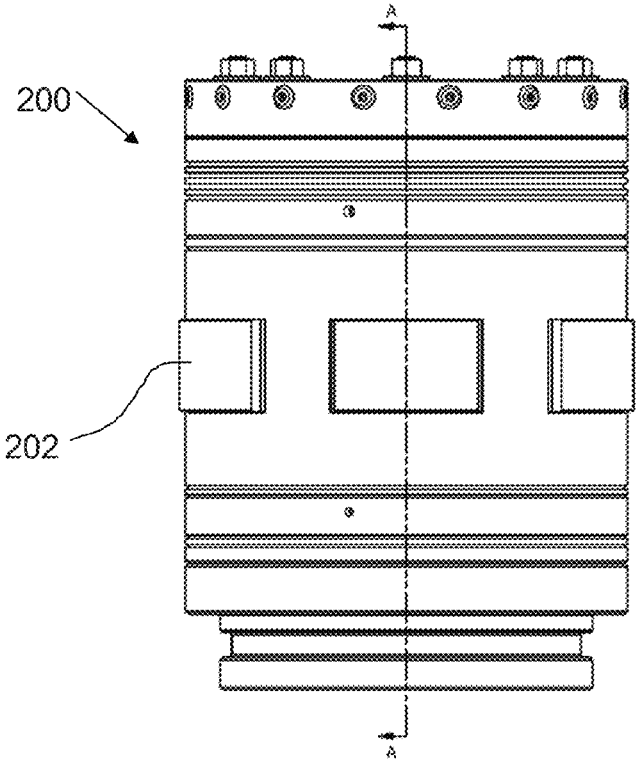
FIG. 10 is a side elevation view of an alternative latching assembly in a latched position.

Referring to FIGS. 7 and 8, a latching assembly 100 is used to secure a bearing assembly 102 to a riser 104. Riser 104 has a port 106 that is designed to be attached to a conduit (not shown) for pumping fluids, such as drilling mud. Bearing assembly 102 may include a bearing section and a seal section, which may be separate or integrally formed. The actual configuration of bearing assembly 102 will vary depending on the preferences of the user and the demands of the situation. As can be seen, latching assembly 100 preferably carries bearing assembly 102 and latches to riser 104. While latching assembly 100 and bearing assembly 102 are shown as separate components, they may be integrally formed, depending on the space requirements and preferences of the user. During normal operation, latching assembly 100 and bearing assembly 102 support a tubular 108, such as a drill string, that passes through each assembly 100 and 102 and through one or more seals 110. Bearing assembly 102 may be removed by unlatching latching assembly 100, and pulling bearing assembly 102 to surface. As latching assembly 100 is removed with bearing assembly 102, it can be serviced at the same time as bearing assembly 102. Referring to FIGS. 9 and 10, the latches can be seen extending from latching assembly 100.

Figure 1:
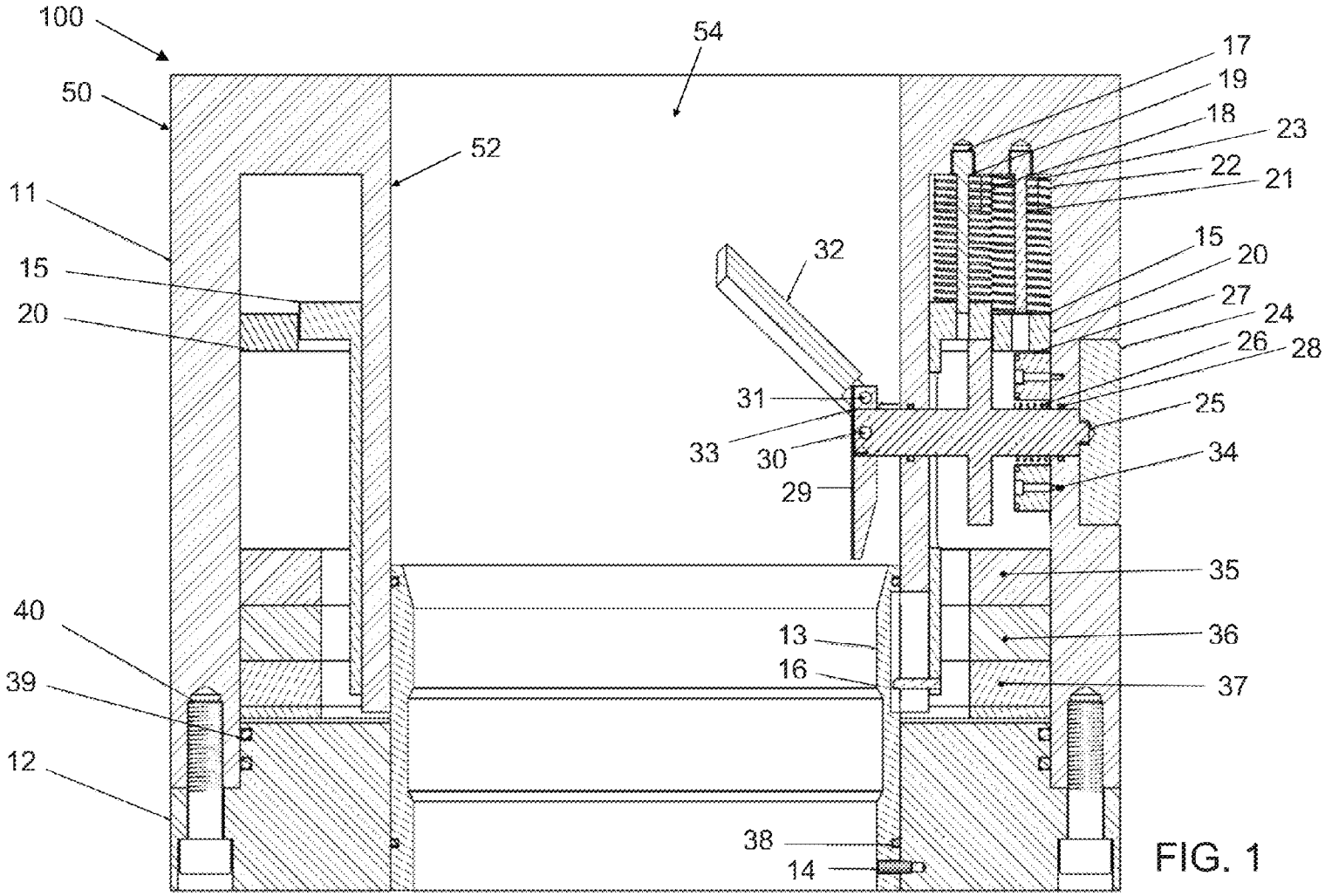
FIG. 1 is a side elevation view in section of a latching assembly in a released position.
Figure 2:
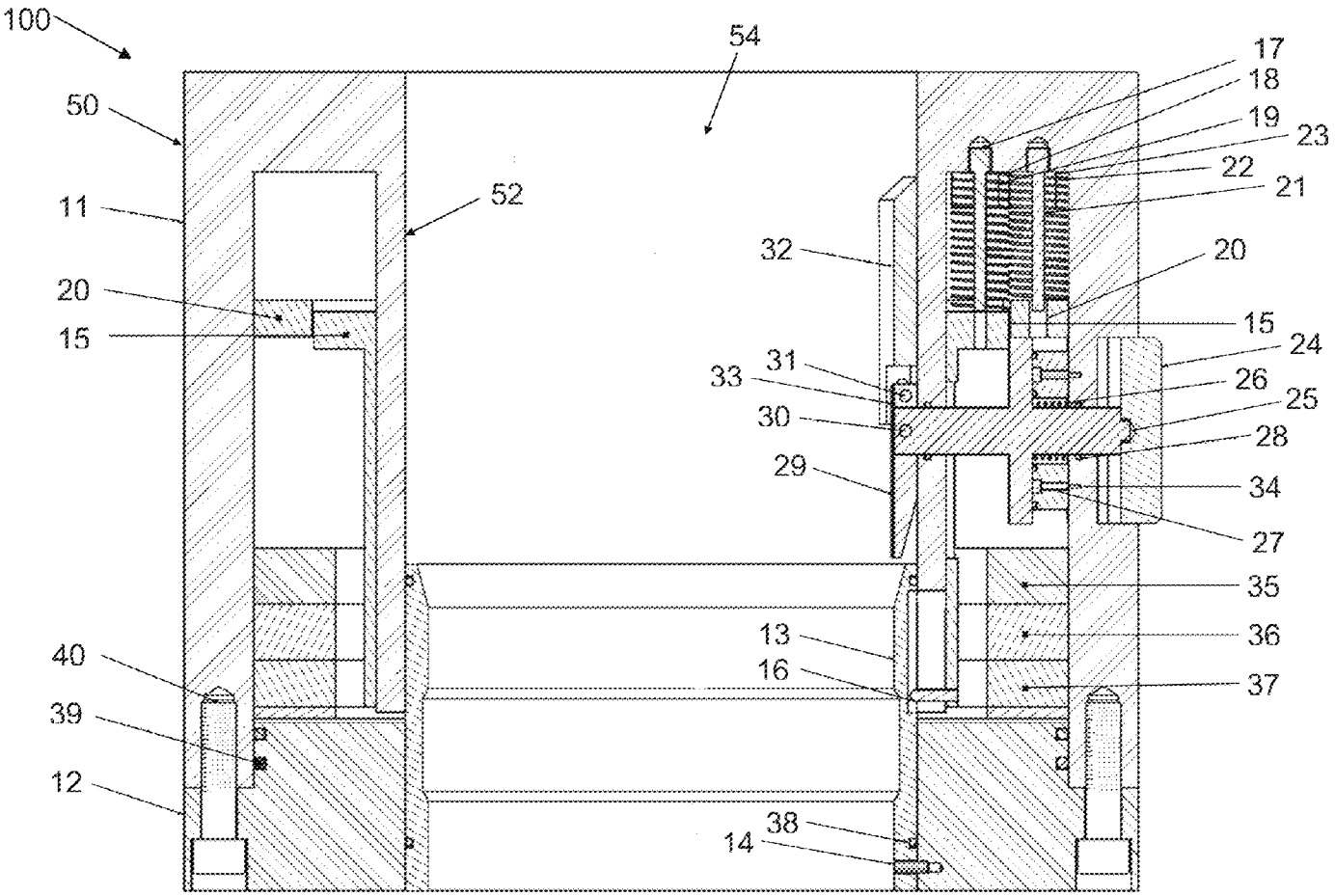
FIG. 2 is a side elevation view in section of a latching assembly in a latched position.
Figure 3:
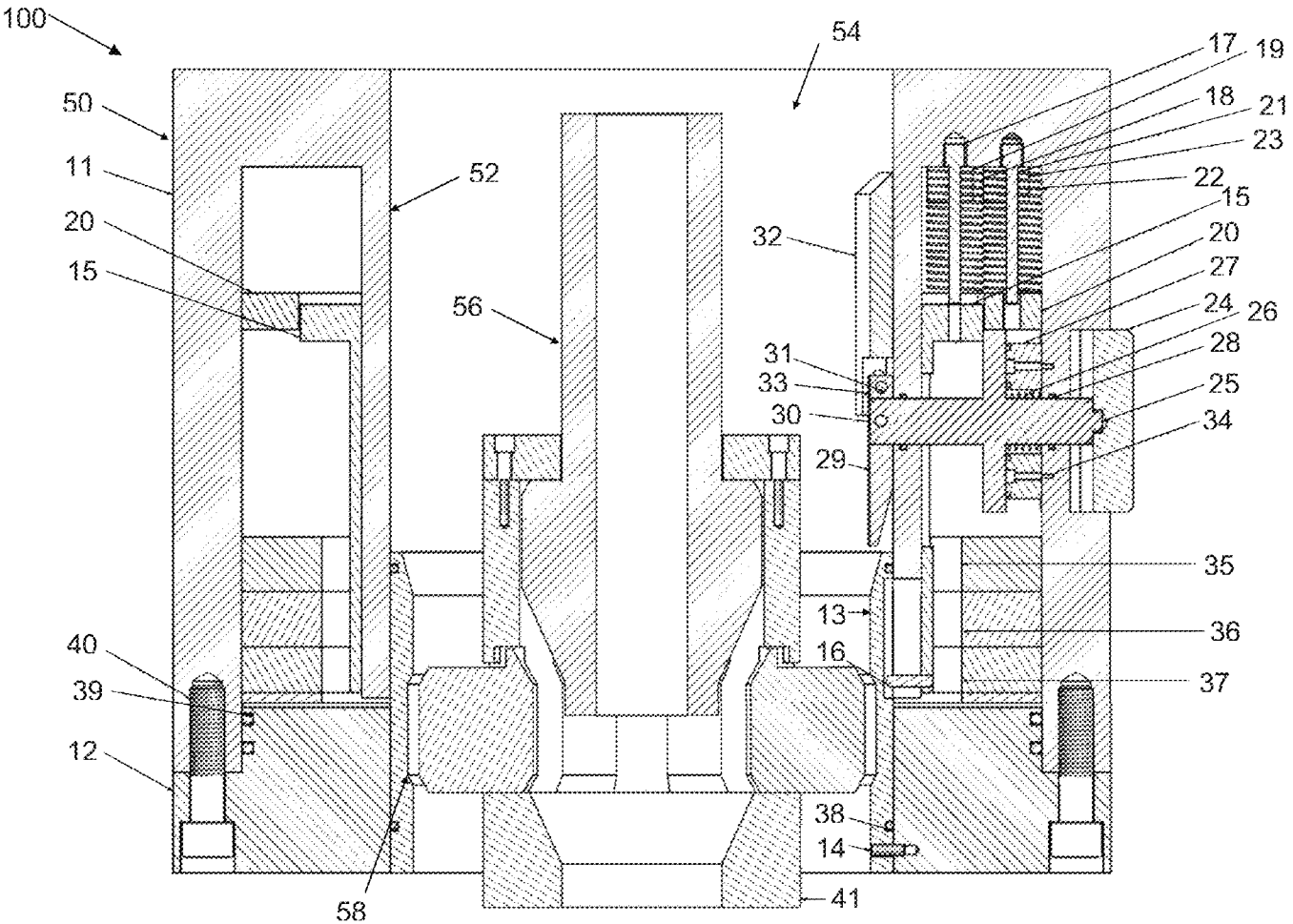
FIG. 3 is a side elevation view in section of a latching assembly in a released position with a running tool positioned within the assembly.

Referring to FIGS. 1 and 2, details of the latching assembly are shown. The example shown in FIGS. 1-6 has the following elements indicated by reference numbers:

11—housing
12—bottom cap
13—unlock sleeve
14—shear pin
15—latch lock ring
16—latch lock ring pin
17—latch lock ring guide pin
18—latch lock ring return spring
19—latch lock ring electrical device
20—unlatch lock ring
21—unlatch lock ring guide pin
22—unlatch lock ring spring
23—unlatch lock ring electrical device
24—latch segment
25—latch shaft
26—latch spring
27—latch electrical device
28—latch shaft o-ring
29—unlock sleeve segment
30—unlock sleeve segment pin
31—unlock sleeve fulcrum pin
32—retrieval arm
33—retrieval arm anchor pin
34—electrical device mount bolt
35—self control power source (SCPC)-1
36—self control power source (SCPC)-2
37—wireless device
38—unlock sleeve o-ring
39—bottom cap o-ring
40—bottom cap bolts
41—unlatch running tool Referring to FIG. 1, there is a tubular housing 11 with an outer surface 50 and an inner surface 52 that defines an inner bore 54. A latch 24 is carried by the housing 11 that has a latch position as shown in FIG. 2 extending out from the outer surface and a release position as shown in FIG. 1 refracted from the latch position, preferably flush with or recessed from the outer surface 50 of the housing 11, but in any event, sufficiently refracted to disengage from the corresponding groove or aperture in the riser (not shown). An electrical actuator 27, such as an electromagnet, moves the latch 24 between the latch position and the release position. The electrical actuator 27 may take other forms as well, and may apply forces in either direction, depending on the signal being transmitted. Alternatively and as shown, the latch 27 may be biased by a spring 26 or other resilient member, toward the unlatched position as shown, or the latched position in other embodiments, such that the electrical actuator 27 merely applies a force to move the latch to the other position.

The latch 24 is secured by a first locking element 15 that moves between a locked position to secure the latch 24 in the latch position as shown in FIG. 2, and a release position to release the latch 24 from the latch position as shown in FIG. 1. As shown, the first locking element 15 is a latch lock ring. Latch lock ring 15 may take other forms, and may be made up of one or more components. Preferably, a second locking element 20 is also provided, shown as a unlatch lock ring, which has a locked position that secures the latch 24 in the release position as shown in FIG. 1, and a release position that permits the latch to move between the latched and the unlatched positions as shown in FIGS. 2-6. As depicted, the locking elements 15 and 20 move perpendicular to the direction of travel by the latch 24. As with the latch 24, each locking element 15 and 20 may be powered by an electrical actuator in either both directions, or only one direction with a biasing element, such as a spring, that biases the locking element toward the other position. As shown, first locking element 15 is moved to a retraced position by an electromagnet 19 and is biased toward an extended position by a spring 18 while second locking element 20 is moved to a retraced position by an electromagnet 27 and is biased toward an extended position by a spring 22.

The latch 24 and the locking elements 12 and 20 are preferably powered by an onboard power source 35 or 36 that is carried by the housing 11, such as a battery pack, and are preferably controlled by a wireless controller 37 that is programmed to control the position of the latch 24, the first locking element 15 and the second locking element 20 based on signals received from a controller (not shown), such as a computer located at an operator's station. The combination of the onboard power source 35 and 36 and the wireless communicator 37 allow the latching assembly 100 to operate without any umbilicals running to the assembly 100.

Referring to FIGS. 3-6, in addition to the latch 24 described above, the latching assembly 100 also preferably includes a tubular gripping assembly as well as a secondary release mechanism.

The latching assembly 100 has a cantilevered gripping member 32 that is positioned within the inner bore 54 of the housing 11. The gripping member 32 is connected to the housing 11 by a movable connection such as fulcrum pin 31, and is also preferably connected to the latch 24. As depicted in FIG. 1, as the latch 24 moves toward the release position, the latch 24 pushes out on the cantilevered gripping member 32, causing it to pivot about the movable connection 31 and therefore extend into the inner bore 54, allowing it to engage a tubular member (not shown), such as a drill string or running tool. Depending on the tolerances and the actual movement of the various component, it will be understood that the movable connection 31 or the engagement of the latch 24 may require some lateral movement as well as pivoting movement to accommodate the movement of the latch 24. The cantilevered gripping arm 32 may be used to grip, for example, a joint of a tubular member such as a drill string or a portion of a running tool, etc. that has an enlarged radius or other gripping surface.

Figure 4:
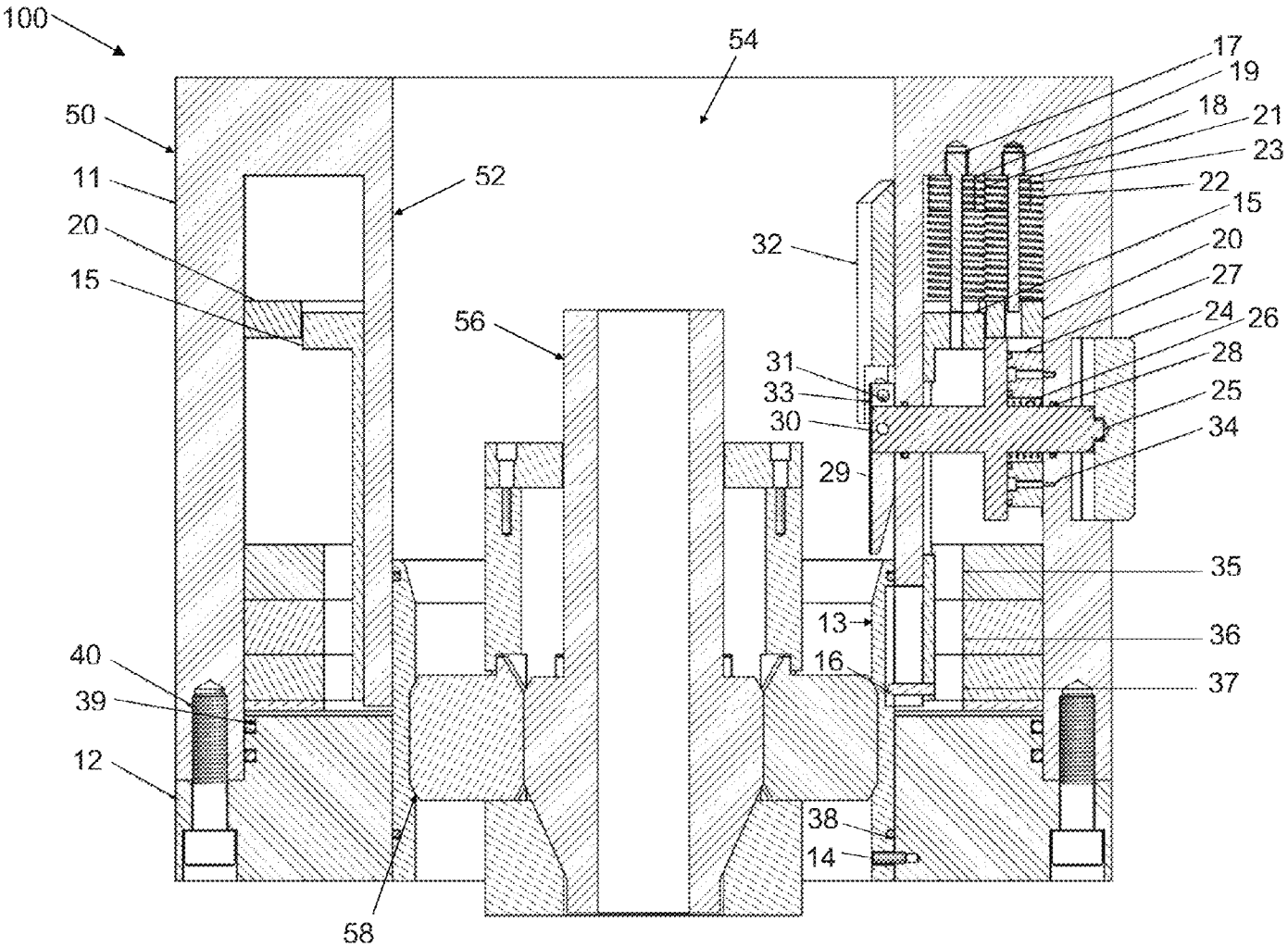
FIG. 4 is a side elevation view in section of a latching assembly and the running tool expanded to engage the assembly.
Figure 5:
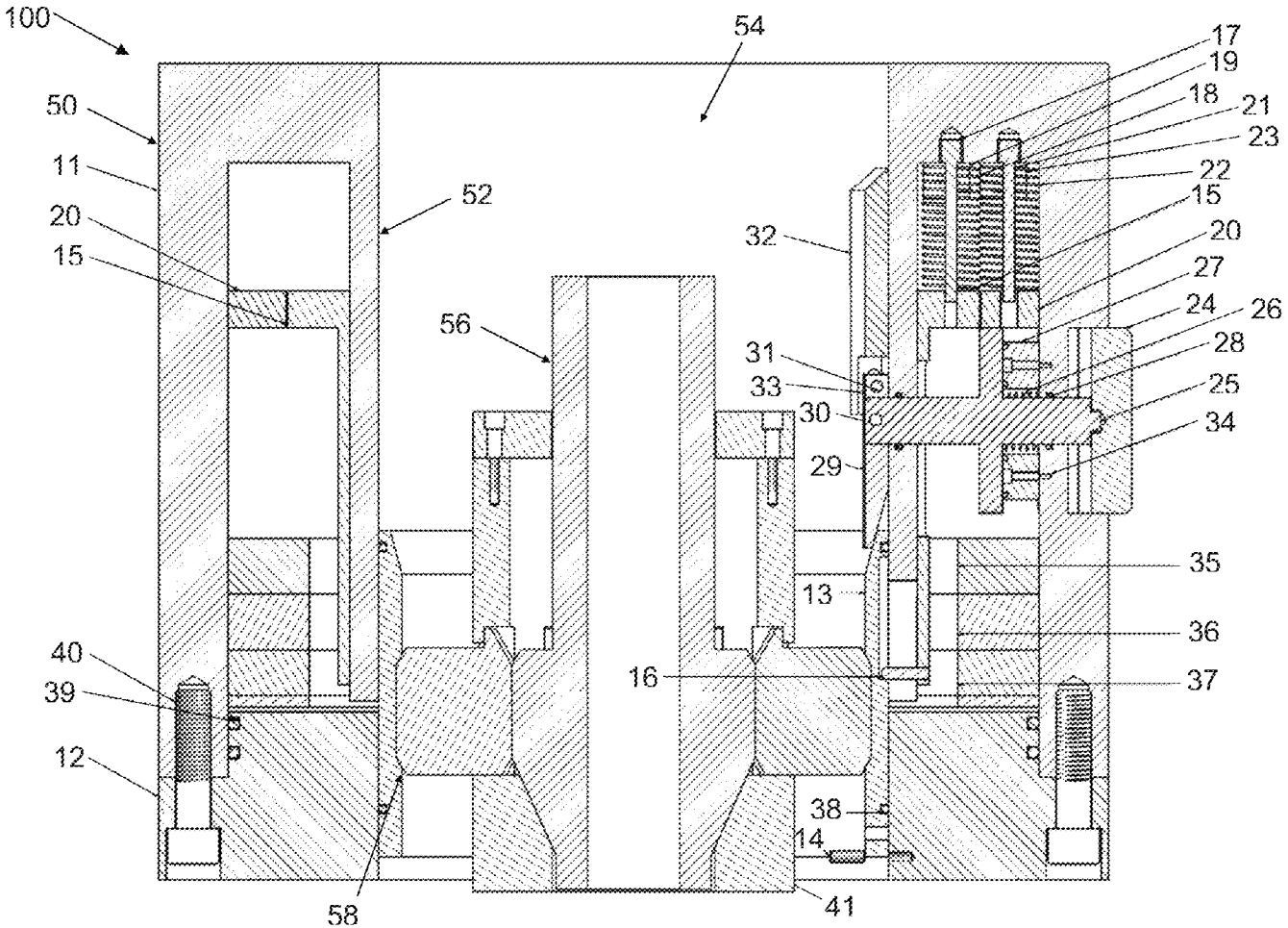
FIG. 5 is a side elevation view in section of the latching assembly being actuated toward a release position.
Figure 6:
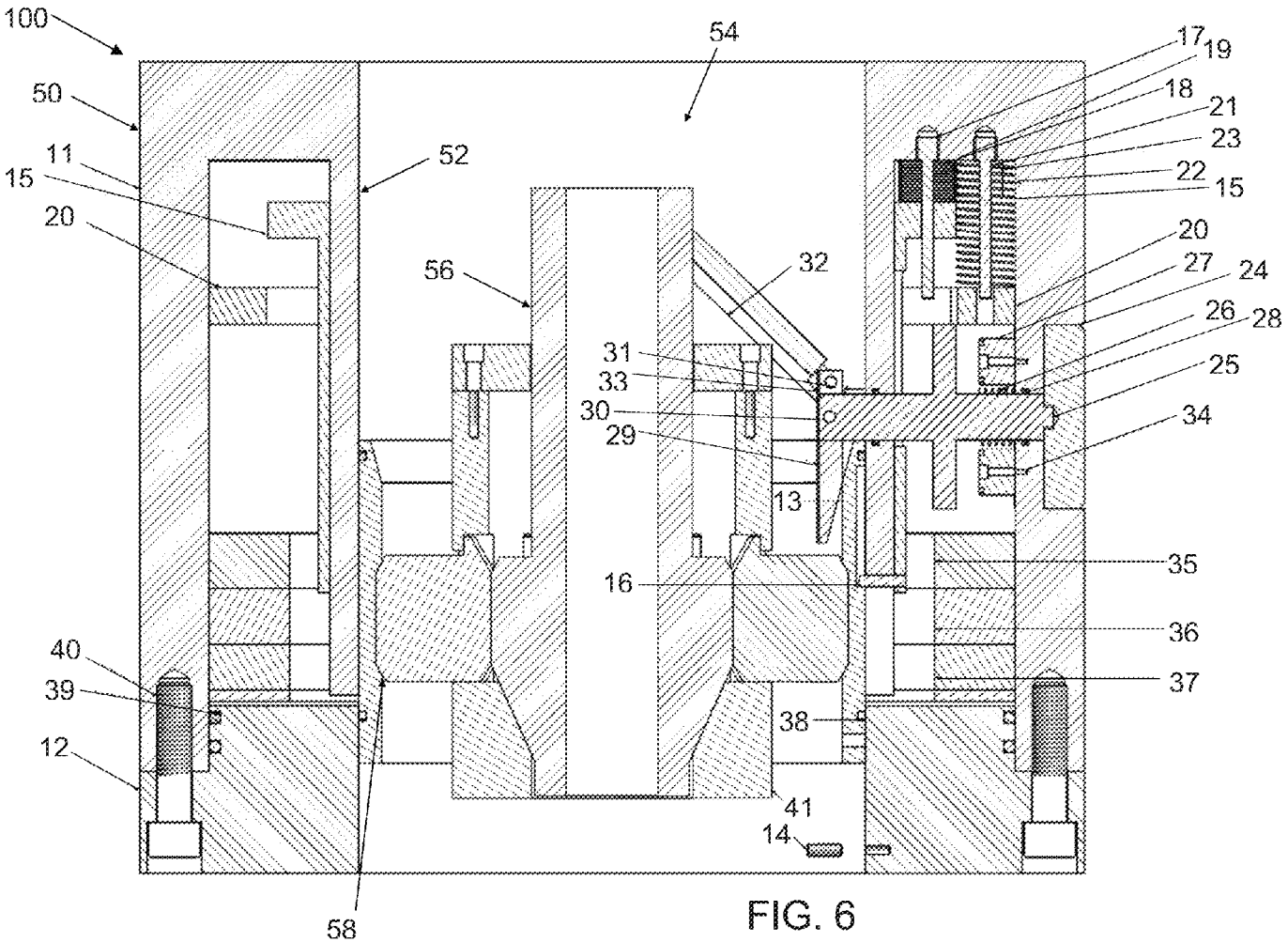
FIG. 6 is a side elevation view in section of the latching assembly in a released position.

Referring to FIGS. 3-6, the secondary release element 29 is also connected to move with the latch 24 and is engaged by a collar or unlock sleeve 13 that is slidably engaged within the inner bore 54 of the housing 11. As shown, the secondary release element 29 is secured to the inward end of the latch 24 and extends downward opposite the cantilevered gripping arm 32 in the depicted example. The collar 13 engages the secondary release element 29 as it is raised and applies a force to move the latch 24 to the release position. As shown, the collar 13 is preferably engaged by a running tool 56 that engages the collar 13, such as by expanding outward to become secured within an inner profile 58 of the collar 13 as shown in FIG. 4, which allows an upward force to be applied to the collar 13 to engage the secondary release element 29, as shown in FIG. 5. The collar 13 and the secondary release element 29 preferably have complementary sloped surfaces, such that, as the collar 13 is raised, the slopes are engaged, and a force is applied to release the latch 24 as shown in FIG. 6, which also moves the gripping members 32 of the tubular gripping assembly to engages the running tool 56. In this position, the latching assembly is locked into the release position and is securely attached to the running tool 56 and can therefore be safely removed. The secondary release element 29 may be useful if the latch 24 becomes stuck in the latched position due to a buildup of debris, mechanical or electrical failure, etc. It may also be used as a secondary lock against the latch 24 moving to the latched position during removal, and in the depicted example, helps maintain the cantilevered gripping arm in the gripping position.

A preferred example of a latching assembly will now be described with respect to FIGS. 1-6. The assembly 100 is designed to operate a mechanical latching and retrieval assembly via remote control without the aid of umbilical lines or power cables. In this example, the assembly is preferably powered by a self-contained power source. The mechanical latch assemblies are operated by an electrical device, where the direction in which the latches are operated is determined by the polarity the current is applied to the electrical device. The assembly is controlled by a wireless device inside the housing, and the wireless device is controlled by a stand-alone workstation situated elsewhere, such as at surface. The operation of this preferred example of the device will now be given, with reference to the drawings.

Referring to FIGS. 1 and 2, the initial latching procedure of the depicted example will now be described:

1. Signal is sent to wireless device 37 via remote work station
2. Wireless device 37 sends signal to electrical device 27 which receive power from self-contained power source 35
3. Electrical device 27 moves latch shaft 25 which is connected to latch segment 24, which is pushed outwards from housing 1 into the lock position, from the position shown in FIG. 1 to the position shown in FIG. 2.
4. Latch lock ring 15 is moved by electrical device 19 and with the aid of latch lock ring spring 18 into lock position behind latch shaft 25, as shown in FIG. 2.

Referring to FIGS. 5 and 6, the unlatching procedure will now be described:

1. Signal is sent to wireless device 37 via remote work station
5. Wireless device 37 sends signal to electrical device 19 which receive power from self-contained power source 35
2. Latch lock ring 15 is moved out of lock position behind latch shaft 25.
3. Electrical device 27, which receives power from self-contained power source 35 moves latch shaft 25 and latch segment 14 that is attached with the aid of latch springs 26 into the unlatched position.
6. Electrical device 23 which receive power from self-contained power source 35 moves unlatch lock ring 20 with the aid of unlatch lock ring spring 22 into the lock position in front of latch shaft 25

Referring to FIGS. 5 and 6, the procedure for extending the retrieval arm will now be described:

1. Signal is sent to wireless device 37 via a remote work station
2. Electrical device 27, which receives power from self-contained power source 35 moves latch shaft 25 and latch segment 24 that is attached with the aid of latch springs 26 into the unlatch position
3. Latch shaft 25 pushes unlock sleeve segment pin 30 with attached unlock sleeve segment 29 which pushes unlock sleeve fulcrum pin 31 which pushes retrieval arm 32 and forces it to pivot outwards due to retrieval arm anchor pin 33

Referring to FIGS. 5 and 6, the procedure for retracting the retrieval arm will now be described:

1. Signal is sent to wireless device 37 via remote work station
2. Electrical device 23, which receives power from self-contained power source 35, moves unlatch lock ring 20 into the unlock position below latch shaft 25
3. Electrical device 27, which receive power from self-contained power source 35, moves latch shaft 25 and latch segment 24 that is attached into latch position
4. Latch shaft 25 pulls unlock sleeve segment pin 30 with attached unlock sleeve segment 29 which pulls unlock sleeve fulcrum pin 31 which pulls retrieval arm 32 and forces it to pivot inwards due to retrieval arm anchor pin 33.

Referring to FIGS. 5 and 6, the procedure for retrieving the bearing using a running tool will now be described:

1. Unlatched running tool 41 is run in hole via drill pipe
2. Unlatched running tool 41 is landed in profile of unlock sleeve 13
3. Unlock sleeve 13 is moved upwards shearing shear pins 14
4. Unlock sleeve 13 continues to travel upwards and contacts latch lock ring pin 16 which is attached to latch lock ring 15 and begins to moves upwards 5. Latch lock ring 15 moves out of lock position and allows latch shaft 25 to move inwards via latch spring 26
6. Unlock sleeve 13 continues to travel upwards and contacts unlock sleeve segment 29 which is attached to unlock sleeve segment pin 30 which pulls lock shaft 25 inwards to ensure latch segment 24 is fully retracted to unlock position.
7. Unlock sleeve 13 continues to travel upwards and contacts unlock sleeve segment 29 which is attached to unlock sleeve segment pin 30 which pushes unlock sleeve fulcrum pin 31 which pushes retrieval arm 32 and forces it to pivot outwards due to retrieval arm anchor pin 33
8. Unlatch lock ring 20 moves into lock position with the aid of unlatch lock ring spring 22 preventing latch shaft 25 from moving.

Figure 11:
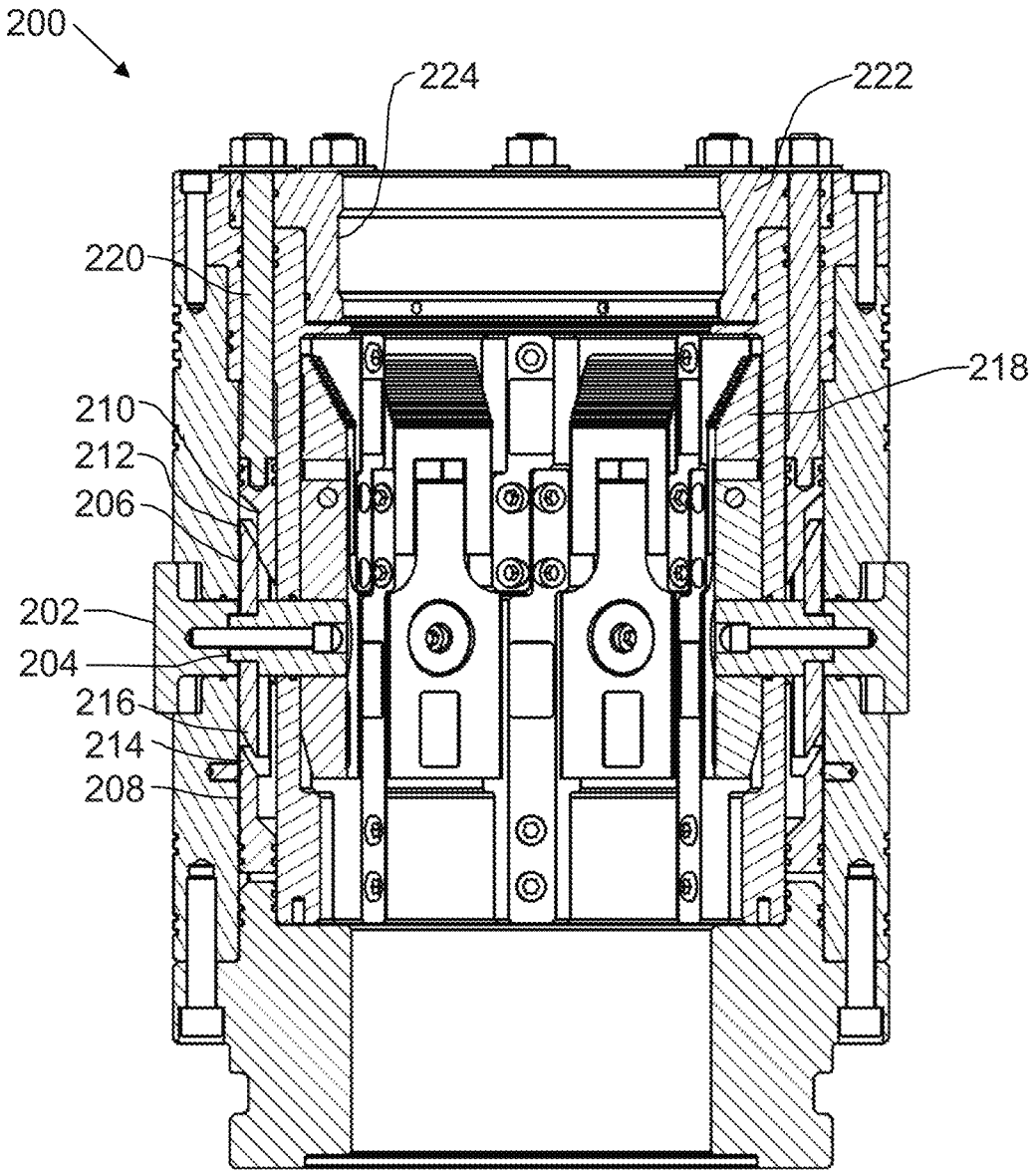
FIG. 11 is a side elevation view in section of an alternative latching assembly in a latched position.
Figure 12:
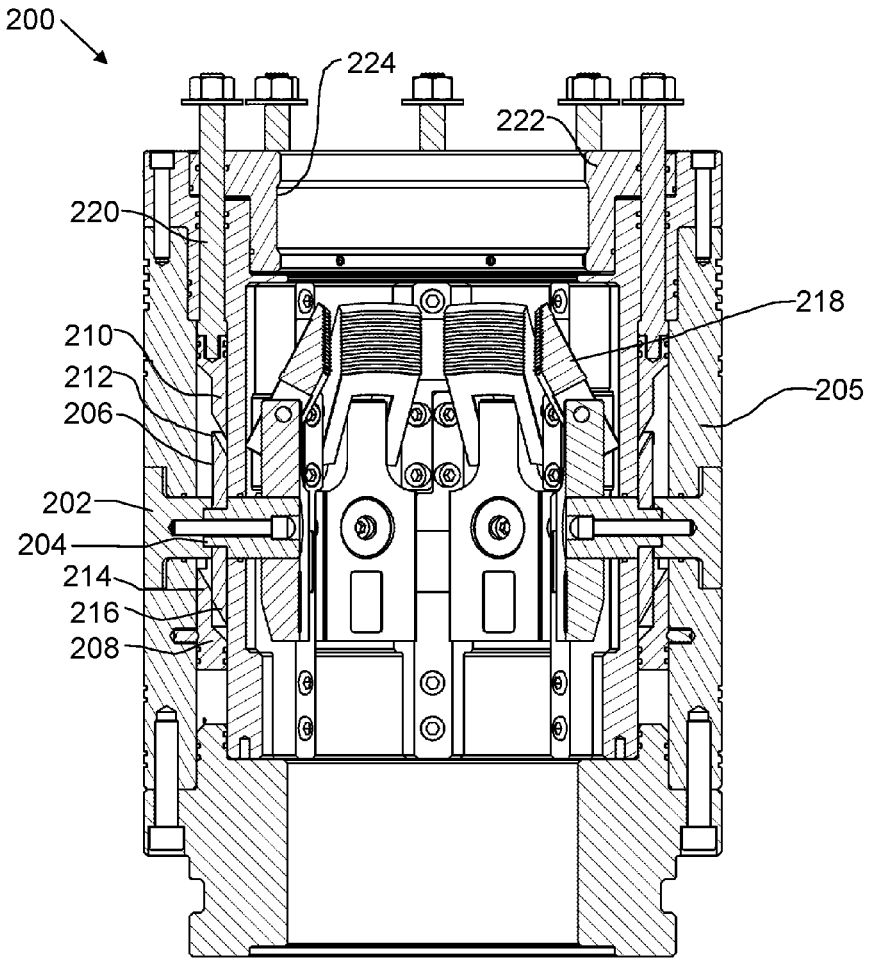
FIG. 12 is a side elevation view in section of an alternative latching assembly in a release position.

Referring to FIGS. 11 and 12, an alternative latching assembly 200 is shown. In this example, the latch 202 is carried on a shaft 204 within the housing 205 having a sloped plate 206. The force to move the shaft 204 and therefore the latch 202 is applied to the sloped plate 206. The latching actuator 208 that controls the position of the latch 202 includes an upper portion 210 that engages a top end 212 of the plate 206 and a lower portion 214 that engages a bottom end 216 of the plate 206. As the latching actuator 208 engages the sloped plate 206, the latch 202 is forced out to the latch position as shown in FIG. 11, in which the latch 202 engages the riser assembly (not shown), or back to the release position as shown in FIG. 12, in which the latch 202 is refracted to be flush with the housing 205. As can be seen, the latching actuator 208 overlaps the sloped plate 206 in an axial direction such that it locks the latch 202 in either the latched position or the released, refracted position. As with the example described above, cantilevered gripping members 218 are provided that are forced inward when the latches 202 move to the release position, such that the gripping members 218 grip the tubular member (not shown) passing through the latching assembly 200. While the controls are not shown in this example, the latching actuator 208 is preferably a piston that is driven hydraulically.

Figure 13:
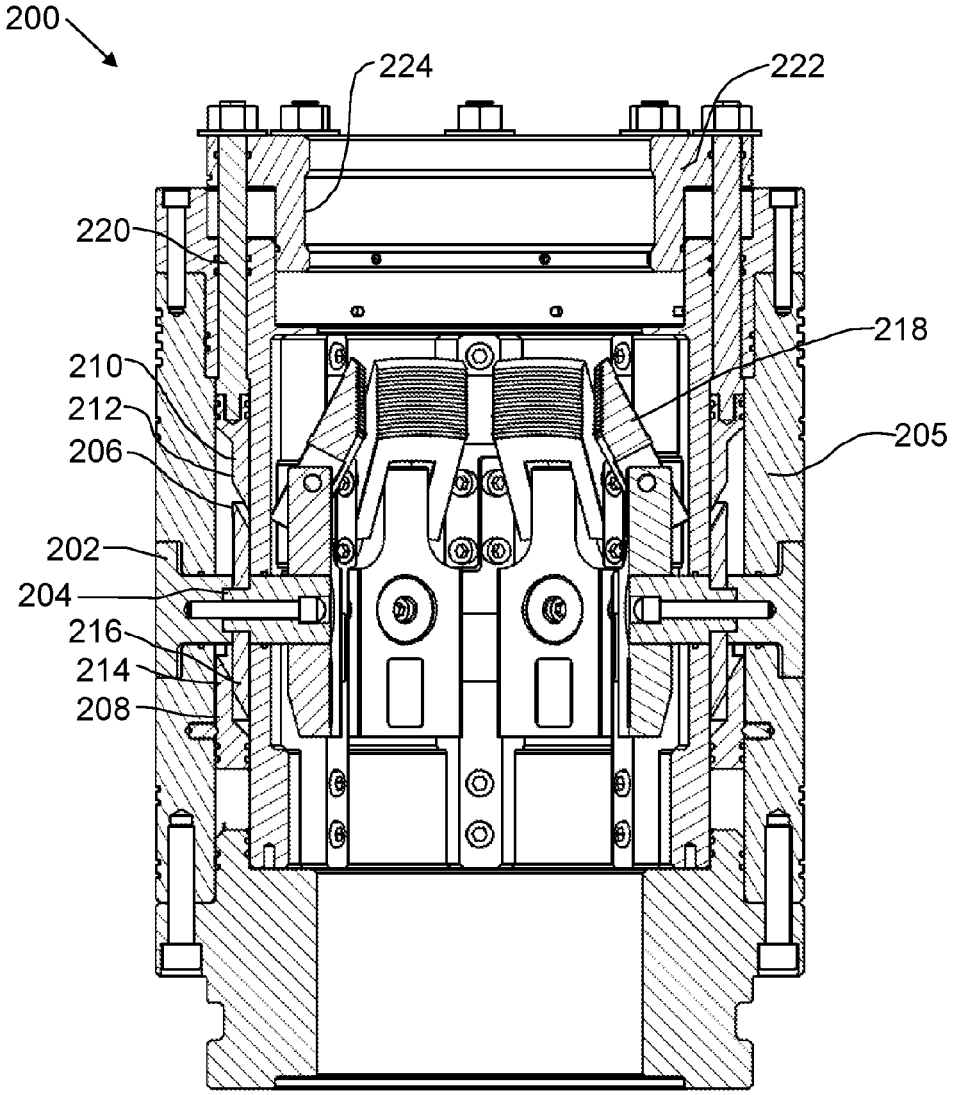
FIG. 13 is a side elevation view in section of an alternative latching assembly in a manually released position.

At the top of the assembly 200 are a series of bolts 220 that act as a mechanical linkage and are mechanically connected to the latching actuator 208. Should it become necessary, an upward force can be applied to the series of bolts 220 to cause the latching actuator 208 to move upward and force the latches 202 to move to the release position. During normal operation, the bolts 220 will move up and down with the latching actuator 208, as shown in FIGS. 11 and 12, but will not affect the operation of assembly 200. However, bolts 220 provide a manual release for the assembly 200 in the event that there a failure in the normal operation of the assembly. As depicted, the housing 205 has an upper section 222 with an engagement surface, in this case an inner groove 224, that engages with a release tool (not shown). Once the inner groove 224 is engaged, the release tool may then apply an upward, mechanical force to the upper section 222. As the upper section 222 is lifted, it engages the bolts 220 and lifts them as well. The upward force on the bolts 220 that are connected to the latching actuator 208 provide a second motive force, this one mechanical, to lift the latching actuator 208. As the latching actuator 208 is lifted, it engages the latches 202 and pulls them back to the release position as shown in FIG. 13. As the latches 202 are released, it also causes the cantilevered gripping members 218 to move inward, such that any pipe joints will be gripped by these members, and allow the assembly to be lifted to surface with the tubing string even if the release tool fails. Shear pins or other releasable locks may be provided to ensure that the manual release is not activated unintentionally.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. A latching assembly, comprising:
- a tubular housing having an outer surface and an inner surface that defines an inner bore;
- a latch carried by the housing having a latch position that extends out from the outer surface and a release position that is retracted from the latch position;
- an actuator that moves the latch between the latch position and the release position; and
- a first locking element that moves between a locked position to secure the latch in the latch position, and a release position to release the latch from the latch position.

2. The latching assembly of claim 1, wherein the actuator is an electrical actuator.

3. The latching assembly of claim 2, wherein the electrical actuator comprises an electromagnet.

4. The latching assembly of claim 2, further comprising a power source.

5. The latching assembly of claim 2, further comprising a power source carried by the housing.

6. The latching assembly of claim 2, wherein the first locking element is controlled by an electromagnet.

7. The latching assembly of claim 1, further comprising a second locking element that moves between a locked position to secure the latch in the release position, and a release position to release the latch from the release position.

8. The latching assembly of claim 1, wherein the latch comprises a spring element that biases the latch toward the release position.

9. The latching assembly of claim 1, further comprising a wireless controller carried by the housing, the wireless controller being programmed to control the position of the latch, and the first locking element.

10. The latching assembly of claim 1, wherein the first locking element further comprises a spring element that biases the first locking element toward the locked position.

11. The latching assembly of claim 1, further comprising a tubular gripping assembly comprising:
- a cantilevered gripping member positioned within the inner bore of the housing, the gripping member being connected to the housing by a movable connection, the gripping member being engaged by the latch such that movement of the latch to the release position causes the gripping member to pivot about the movable connection and extend into the inner bore to engage a tubular member.

12. The latching assembly of claim 1, further comprising a secondary release element that is carried by the latch and a collar that is slidably engaged within the inner bore of the housing, the collar engaging the secondary release element as it is raised and applying a force to move the latch to the release position.

13. The latching assembly of claim 12, wherein the secondary release element and the collar each comprise complementary sloped surfaces.

14. In combination:

a riser defining a central bore;

a drill string extending through the riser;

the latching assembly of claim 1 positioned within the central bore of the riser and receiving the drill string within the inner bore of the housing of the latching assembly;

a sealing and bearing assembly mounted to the drill string and attached to the latching assembly.

15. A latching assembly, comprising:

a tubular housing having an inner surface that defines an inner bore and an outer surface;

a latch that moves between a latch position that extends out from the outer surface and an unlatched position that is retracted from the latch position;

a latching actuator that moves between a first axial position that moves the latch to the latch position and a second axial position that moves the latch to the unlatched position; and a manual release that moves axially in response to a mechanical force to selectively move the latching actuator to the second axial position.

16. The latching assembly of claim 15, wherein the latching actuator comprises a first portion and a second portion, the latch being spaced axially between the first and second portions, wherein, in the first axial position the first portion moves the latch to the latch position and in the second axial position the second portion moves the latch to the unlatched position.

17. The latching assembly of claim 15, wherein the latching actuator engages the latch by sloped surfaces to move the latch between the latch position and the unlatched position.

18. The latching assembly of claim 15, wherein the latching actuator locks the latch in each of the latch position and the unlatched position.

19. The latching assembly of claim 15, wherein the latching actuator is hydraulically driven.

20. The latching assembly of claim 15, wherein the manual release comprises a lifting ring having an engagement for engaging with a lifting tool that applies the mechanical force to the manual release.

21. The latching assembly of claim 15, wherein the manual release is connected to the latching actuator by a mechanical linkage, the mechanical linkage transferring the mechanical force to the latching actuator.

* * * * *